US005507445A

United States Patent [19]

Lohmuller

[11] Patent Number: 5,507,445

[45] Date of Patent: Apr. 16, 1996

[54] PROCESS AND DEVICE FOR DEPOSITING WIRE LOOPS INTO A DRUM PACK

[75] Inventor: Bernd Lohmuller, Schwabach, Germany

[73] Assignee: Maschinenfabrik Niehoff GmbH & Co. KG, Schwabach, Germany

[21] Appl. No.: 302,897

[22] PCT Filed: Mar. 8, 1993

[86] PCT No.: PCT/EP93/00519

§ 371 Date: Nov. 30, 1994

§ 102(e) Date: Nov. 30, 1994

[87] PCT Pub. No.: WO93/18871

PCT Pub. Date: Sep. 30, 1993

[30] Foreign Application Priority Data

Mar. 18, 1992 [DE] Germany ..... 42 08 724.4

[51] Int. Cl.[6] ..... B21C 47/14; B21C 49/00

[52] U.S. Cl. ..... 242/361.1

[58] Field of Search ..... 242/361.1, 362.1, 242/360, 361, 361.2, 361.3, 361.4, 361.5, 362, 362.2, 362.3, 363

[56] References Cited

U.S. PATENT DOCUMENTS

| | | | |
|---|---|---|---|
| 2,957,640 | 10/1960 | Lewis, Jr. . | |
| 3,054,570 | 9/1962 | Nye | 242/361.4 |
| 3,088,690 | 5/1963 | Haugwitz | 242/361.1 |
| 3,776,076 | 12/1973 | Hauck | 83/167 |

FOREIGN PATENT DOCUMENTS

| | | |
|---|---|---|
| 2038133 | 2/1971 | Germany . |
| 2213172 | 11/1972 | Germany . |
| 2708857 | 9/1977 | Germany . |
| 3116089 | 11/1982 | Germany . |
| 442932 | 1/1968 | Switzerland . |

*Primary Examiner*—John M. Jillions
*Attorney, Agent, or Firm*—Parmelee, Bollinger & Bramblett; George W. Rauchfuss, Jr.

[57] ABSTRACT

A process and device are disclosed for positioning the wire while the drum packs of a drum pack winding device are exchanged. Storage fingers are provided for retaining the wire windings around a winding core while the drum packs are exchanged. In order to avoid the falling of the collected windings into the empty drum pack from being obstructed due to the connection between said windings and the filled drum pack, a wire positioning device brings the hanging wire into a position located below the storage fingers, which position is well-suited for the changing of the drum packs. The wire is held in this position until the new drum pack is in the winding position. The wire positioning device is then brought back to its initial position and the wire can fall into the empty drum pack without any obstructions.

17 Claims, 3 Drawing Sheets

PROCESS AND DEVICE FOR DEPOSITING WIRE LOOPS INTO A DRUM PACK

The present invention relates to a device for depositing wire windings in a drum pack. The term "wire" is not only to be understood as a bare metal wire but also as a wire which has already been processed, for example, a wire having a varnish or an insolating layer or the like, as well as, a wire strand which may or may not have a covering, and the like.

A drum pack winder of the known type mentioned above comprises a depositing device which normally feeds the wire to the winder at a high velocity and the wire is wound in windings around a stationary cylindrical winding core having a vertical axis. The winding device is formed in such a way that as soon as a predetermined number of wire windings is wound on the winding core, the lowermost wire winding falls in the drum pack. Due to the high wire feeding velocities this process takes place relatively quickly so that five windings or more per second fall in the drum pack.

The drum pack itself is likewise cylindrically formed whereby the (fictitious) cylindrical axis coincides with the (fictitious) cylindrical axis of the winding core. In the drum pack, there is normally a likewise cylindrical drum pack core which prevents the individual windings becoming tangled.

Drum pack winding devices have the advantage that in a short time a large amount of wire can be wound which, on the other hand, can be very quickly pulled out from the drum pack in the case that a further processing is necessary.

A particular problem with the drum pack winder is the changing of the drum pack. Due to the high velocities, the feeding of the wire from, for example, a rolling carriageway, a drawing facility or the like, cannot be interrupted when the drum pack is exchanged. As is disclosed in DE-AS 20 38 133, it is therefore normal in the prior art to provide a number of slidable or swingable storage fingers arranged around the winding core which are to be moved on the winding core as soon as the drum pack located in the device is full. As a result, the wire windings are therefore prevented from falling in the drum pack and collect together on the winding core. As soon as the new drum pack is positioned in the winding device, the storage fingers are pulled back and the collected windings fall in the empty drum pack. This phase of the exchanging process is particularly critical since it often occurs that the collected windings get jammed or tilted when falling down and then are partly kept hanging at the guide cylinder or at the drum pack core or become tangled in some other way. In this case, the wire windings which follow can no longer reach into the drum pack and due to the large wire feeding velocity, large amounts of wire collect quickly outside the winding device. Therefore, DE-AS 20 38 133 suggests to develope the storage fingers in the form of an arc according to a type of iris aperture.

DE-OS 27 08 857, shows likewise a corresponding drum pack winding device having four sector-like storage fingers for catching the wire windings during a drum pack exchange and which are transferable from an outer position which does not interfere with the falling of the windings, to an inner position in which the windings are held. A wire cutting device is provided between the holding device and the drum pack in order to cut the wire during a drum pack exchange.

DE-PS 22 13 172, shows a further drum pack changing device. In this case, in order to prevent a jamming or tilting of the windings held during the changing of the drum pack, a cylindrical extension piece is used which is attached onto the drum pack core.

With the above described drum pack changing devices, the wire is cut during the changing of the drum pack. However, with numerous applications it is necessary that the wire is transferred from a filled drum pack into the next empty drum pack without any interruption. This is, above all, the case when a changing of the drum pack takes place within a closed production process and the wire wound in the drum packs afterwards undergoes a further processing.

When the full drum pack is then pushed out sideways from the winding device, a continuous wire piece is produced which reaches from the filled drum pack to the winding core onto which wire windings are also continually wound during the changing process. Should then the storage fingers be pulled back, the danger that the windings jam when falling into the empty drum pack considerably increases with respect to those devices with which the wire is cut during the changing process. When one considers that the filling of a drum pack for some applications requires only a few minutes and therefore a number of drum pack exchanges per hour must be carried out, it is clear that problems with the changing of the drum pack could cause a considerable disturbance in the manufacture operation.

It is therefore the task of the present invention to provide a drum pack winding device and a process for positioning the wire in a drum pack winding device during the drum pack exchange, through which it is achieved that the known problems, that is, in particular the jamming of the wire windings collected on the winding core during the exchange of the drum pack, does not occur when the wire windings fall into the empty drum pack.

With the present invention, first of all, the possibility is achieved to position the wire during the drum pack exchange that it is always found substantially in the same position which does not interfere with the falling of the collected windings. In order to achieve this, a number of movable wire positioning fingers is provided which are guided on a rotatable ring arranged concentric to the winding core whereby the positioning fingers are located underneath the storage fingers. While the storage fingers are all moved on the winding core at the same time in order to hold the wire windings which have collected there, the movement of the positioning fingers with reference to the winding core is controlled such that the positioning fingers are moved successively during a rotation of the ring holding them that they contact the winding core one after the other. As a result, it is ensured that, independent from the position in which the wire is located, before the positioning device is started the wire is always held by the first positioning finger contacting with the winding core. Therefore, it is possible to stop the rotation of the ring such that the falling of the wire in the drum pack is not obstructed by the wire connection to the previously used drum pack which is now full. Consequently, a jamming of the wire windings falling in the drum pack is reliably prevented and a sure operation of the drum pack changing process is ensured.

The invention will now be described in detail with reference to the figures whereby, it is pointed out that all the features mentioned in the description are to be seen as belonging to the invention.

FIG. 1A to 1D show a principal representation of a drum pack presented winding device according to the prior art during the process of changing a drum pack presented for explaining the problems the invention is based on;

Figure 1A:
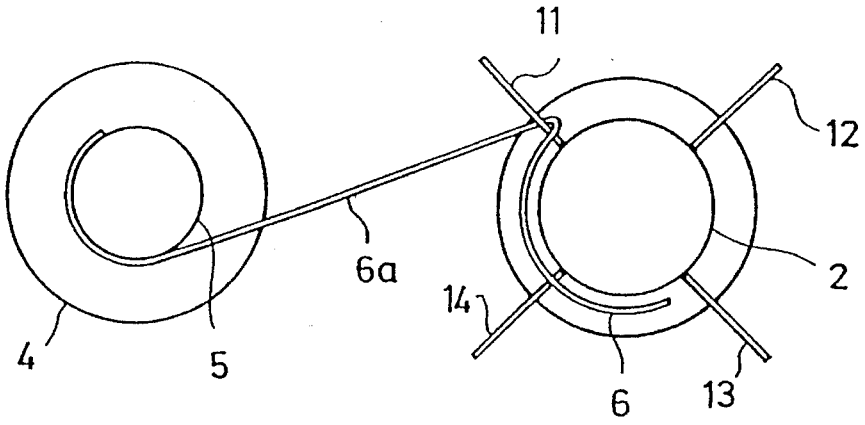
FIG.1A PRIOR ART

The technical problem on which the invention is based will now be described in detail with reference to FIGS. 1A to 1D.

A conventional drum pack winding device is shown in FIGS. 1A–1D comprising an outer jacket 1 and a stationary cylindrical winding core 2 arranged concentric therewith. Wire windings are laid on this winding core with a depositing device or laying-in device not shown in the figures. At the winding core, a device (not shown in the figures) is provided which causes the respective lowermost wire winding to fall into a winding drum pack 4 arranged exactly vertically below the winding core upon reaching a predetermined number of wire windings on the winding core.

The winding drum pack 4 which is normally put together from a metal frame has an outer drum pack covering 4 and an inner drum pack core 5 arranged concentric thereto.

The drum pack winding device is, for example, arranged behind a wire drawing machine intended for non-iron metals, and winds up the wire running out of the machine with a high velocity.

The drum pack winding machine has an automatic drum pack changing device by means of which the full drum pack according to the representation of FIG. 1A is moved leftwards and an empty drum pack is positioned under the winding core 2. Since the production may not be interrupted during the changing of the drum pack, the wire windings which have been run-in during this time are collected on the winding core 2. In order to prevent a falling down of the wire windings, four storage fingers 11, 12, 13, 14 are provided which are arranged with the same angular distance to one another and are moved onto the winding core by a device, not shown, as soon as the first drum pack is full. When now the full drum pack 4 is moved leftwards from the drum pack winding device, the wire connection 6 which is now further wound on the winding core, remains connected with the wire on the winding pack which is indicated by the wire piece **6*a***.

This wire connection is necessary in every case when the wire wound up in the individual drum packs should then be further processed without any interruption. For example, should drum packs 1 to 10 be filled with wire, the further processing can be carried out by the wire being pulled out afterwards from the last i.e. the tenth drum pack and then pulled out accordingly one by one from the other drum packs.

The wire connection **6*a*** however, normally must also be available when the wire is cut between the individual drum packs and the drum packs are individually transported and processed. Since the processing is normally carried out again in automatic facilities, the possibility must be made available that the wire end wound at the beginning in the empty drum pack can be connected with the start of the wire of another drum pack and therefore the wire end should be made accessible and should already be fed out from the drum pack before the winding step.

When the storage fingers, identified with 11, 12, 13 and 14, are guided to the winding core for the changing of a drum pack, the wire loop lying lowermost on the winding core can end after the storage finger 11, as well as after the storage fingers 12, 13 and 14, such that the wire extends from one of said storage fingers to the full drum pack. When this situation arises, as is shown in FIG. 1A, where here the lowermost wire winding ends at the storage finger 11, the process of changing a drum pack is unproblematic. In this situation, the collected windings can fall into the empty drum pack without interference.

The advantage of the position shown in FIG. 1A is that by the extension of the wire piece **6*a* around the storage finger 11 to the storage finger 13, a wire loop is formed which upon the storage finger 11** being pulled back, is so long that the wire winding can fall under without any problems and can be received from the drum pack without any jamming or the like.

Figure 1B:
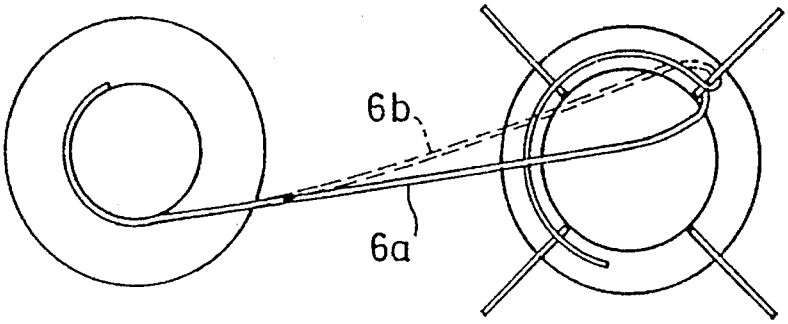
FIG.1B PRIOR ART

Particularly critical is the position according to FIG. 1B i.e., when the lowermost winding ends at the storage finger 12. In this situation, the wire can either extend to the middle axis of the winding core, as is shown by the pulled through wire piece **6*a*, or, it can extend away from the middle point to the full drum pack as is shown by the dashed lines of wire piece 6*b***. In the last case, a knot is formed which makes it considerably more difficult to further process the wire.

Figure 1C:
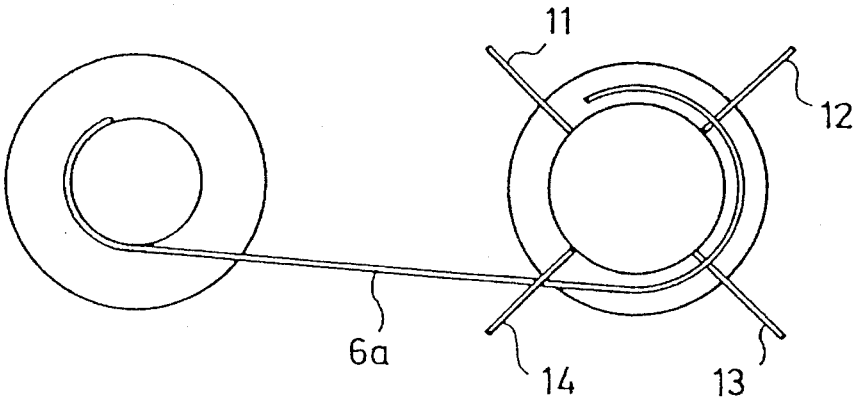
FIG.1C PRIOR ART

According to the representation of FIG. 1C, the lowermost winding ends at the storage finger 13. This means that the wire extends above the storage finger 13 and under the storage finger 14. When the storage fingers are opened in this position there arises the danger that the wire loops will jam when falling down.

Figure 1D:
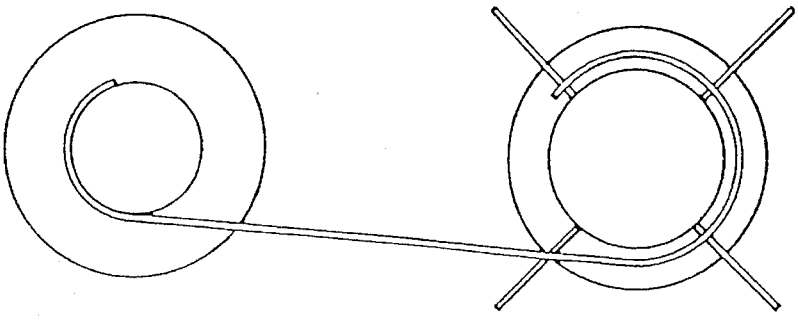
FIG.1D PRIOR ART

The same problem arises also with the situation according to FIG. 1D as with the situation according to FIG. 1C. Here, the danger also arises that the wire windings can jam when falling down.

Figure 2:
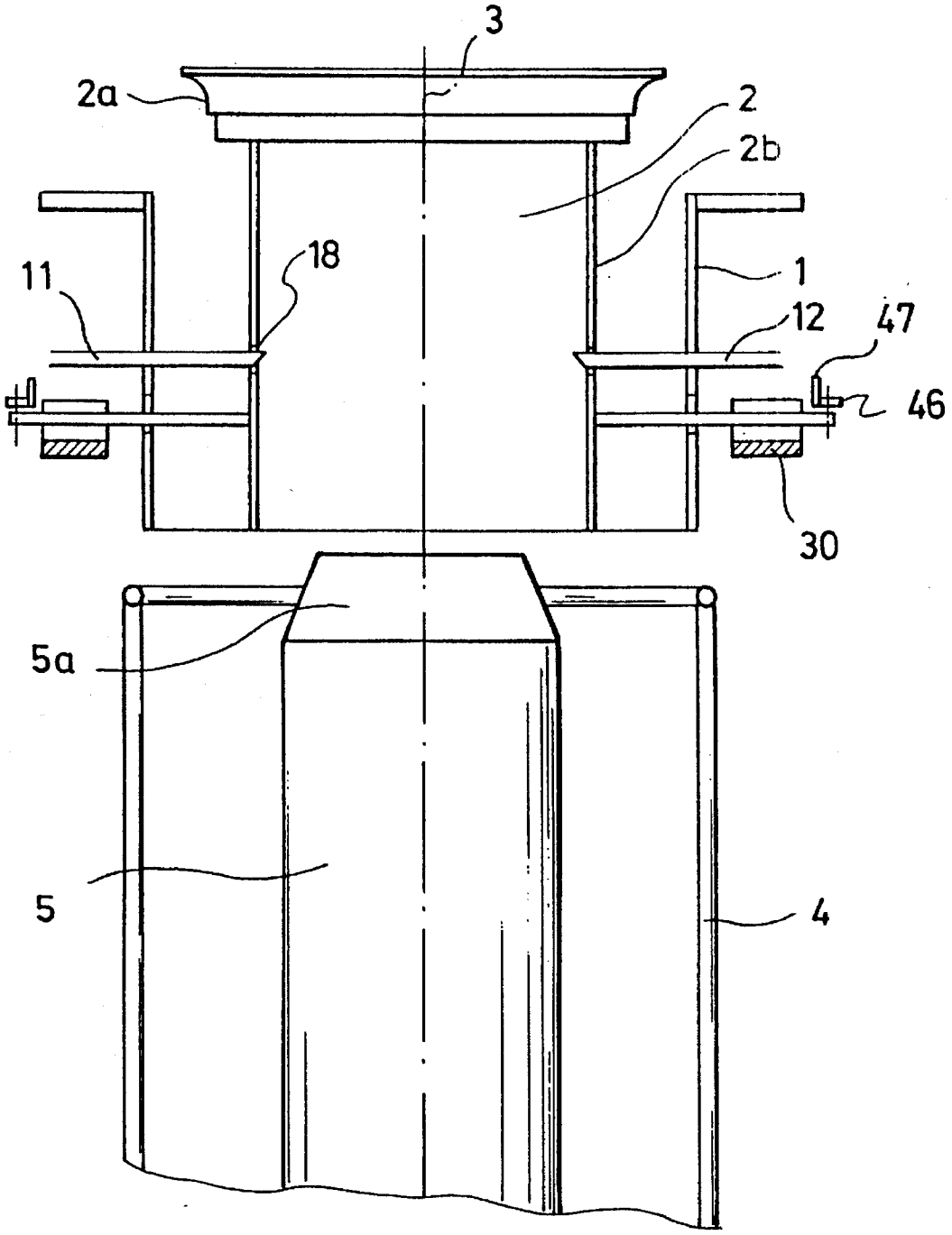
FIG. 2 shows in a principal sketch of a side view of the drum pack winding device according to the invention having a wire positioning device.

The device according to the invention will now be described in reference to FIGS. 2, 3 and 4. For simplification, the same reference numbers are used as in FIG. 1.

The drum pack winding device has a stationary, rotational symmetric winding core 2 whose longitudinal axis is arranged vertically. The winding core 2 has an upper substantially tapered portion **2*a* which serves to receive the wire windings, and a joining cylindrical portion 2*b*** through which the wire windings are guided.

A cylindrical drum pack 4 constructed from a pipe is provided exactly underneath the winding core 2 and has in its interior, a cylindrical drum pack core 5 extending concentric to the outer cylinder, and which is conically tapered in its upper region **5*a*. The (fictitious) cylindrical axis of the drum pack 4 coincides with the axis 3**.

A jacket 1 of the drum pack winding device is arranged concentric to the winding core 2.

In the jacket 1 of the drum pack winding device, four storage fingers 11, 12, 13, 14 are movably guided and are slidable with respect to the winding core 2. The winding core 2 has four openings 18 in which the storage fingers are gripped.

By way of a device, the storage fingers are brought simultaneously into a pulled-back position (the position being shown in FIG. 2) whereby such a device is known in the prior art and therefore is not shown here.

A wire positioning device is arranged underneath the storage fingers 11 to 14. The wire positioning device has a rotating ring 30 arranged concentric to the winding core 2. The ring 30 is formed as a belt disk and receives on its outer circumference a belt 32 placed over a belt disk 33 of a driving motor 35. Three wire positioning fingers 41, 43 and 44 are movably guided in the rotatable ring in such a way that they can be moved in the direction towards and away from the cylinder axis of the winding core as indicated by the double arrow 42 at the positioning finger 41.

Each one of the positioning fingers 41, 43 and 44 has a roller 46 by means of which it is guided to a connecting lever guide 47. The lever guide 47 has a first region **47*a* which extends approximately 180° of a circle in which the lever guide extends concentric to the winding core. In the clockwise direction a second region 47*b*** is joined thereto which significantly reduces the distance of the guide to the winding core. Joining on from this, again in a clockwise direction, is an angular region of around 135° in which no guide is present.

The functioning of this device is as follows:

In normal operation, the windings of a wire being run-in in the winding device are wound around the winding core 2 with a depositing or laying-in device, not shown, in order to then fall in the winding drum pack 4, where they are centred by the drum pack core 5. As soon as the drum pack 4 is filled the storage fingers 11, 12, 13, 14 are moved onto the winding core and prevent further windings being able to fall in the drum pack. The windings are then collected together in the region between the jacket 1 and the winding core 2.

As soon as the storage fingers are brought into their holding position the wire positioning device is activated. At the same time, the motor 35 is switched on via a control device, not shown, and rotates such that the rotatable ring 30 is rotated clockwise. The positioning fingers 41, 43 and 44 also move together with the ring 30 whereby they are supported with the roller 46 on the lever guide 47.

The lever guide 47 comprises a partial region 47*a* arranged concentric to the ring 30. So long as the rollers 46 lie against this part of the lever guide, their distance to the winding core does not change.

In an angular position, which lies behind the angular position of the storage finger 11 seen in a clockwise direction, the lever guide is bent towards the winding core 2, so that in this region, the positioning fingers are brought in contact with the winding core 2 via the rollers 46.

As a result, that the lever guide is so formed that the positioning fingers first reach the winding core behind the storage finger 11, so that the wire is always taken-up by the first positioning finger 41 independent in which position it is found to be in.

Figure 3:
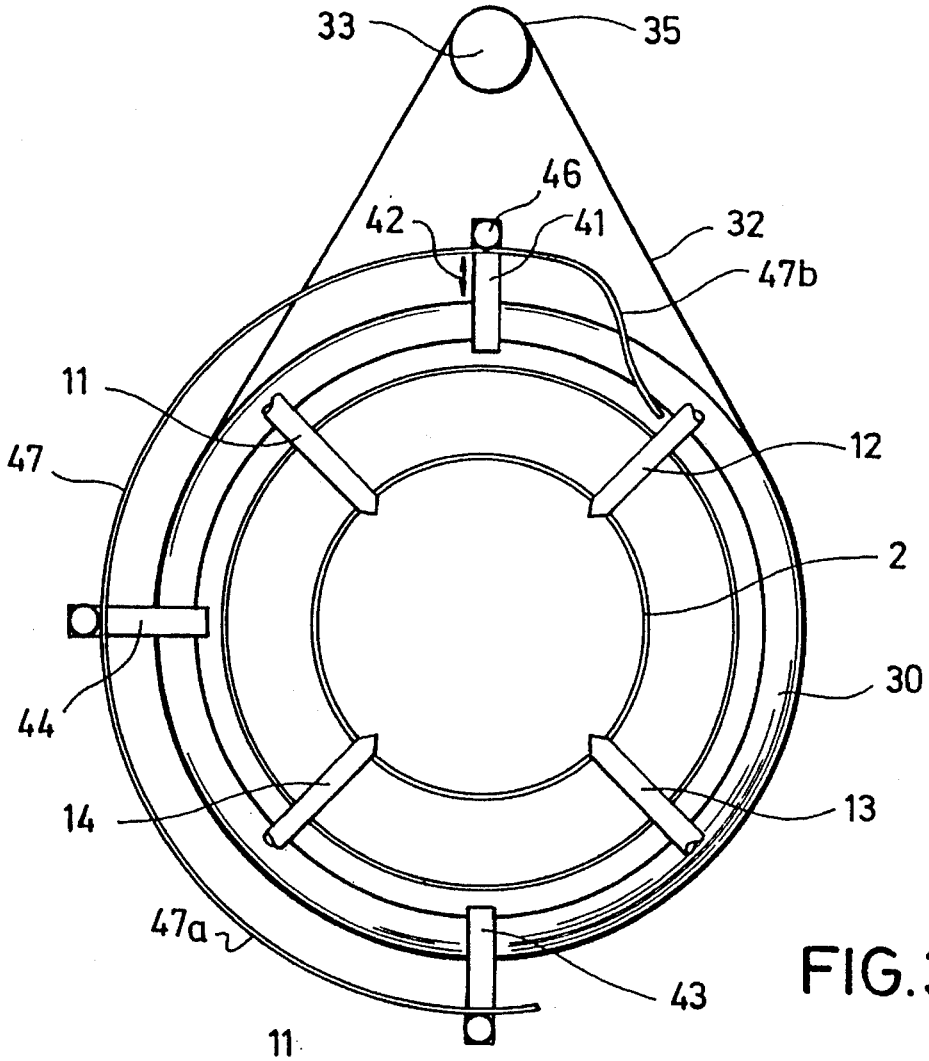
FIG. 3 shows a sectional drawing of the drum pack winding device according to FIG. 2 seen from above whereby, the elements of the wire positioning device are in their initial positions.
Figure 4:
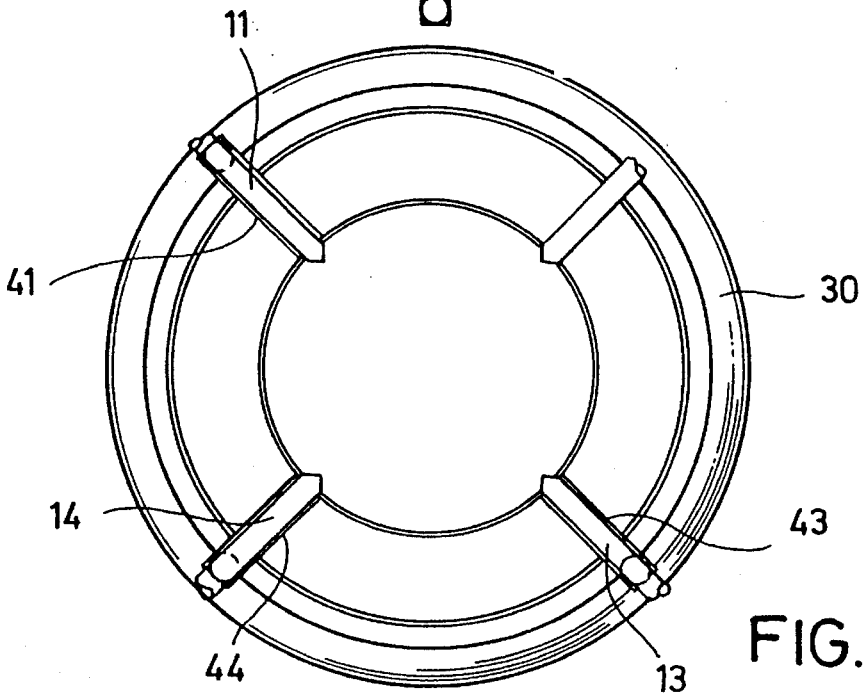
FIG. 4 shows a representation according to FIG. 3 in which the wire positioning device is located in its end position.

The circumferential ring rotates around exactly 315° from the initial position of the embodiment shown in FIG. 3. Thereafter, as can be seen from FIG. 4, the said first positioning finger 41 lies exactly under the storage finger 11, the second positioning finger 44 is exactly under the storage finger 14 and the third positioning finger 43 is exactly under the storage finger 13. Since the wire always hangs above the first positioning finger 41, it is therefore ensured that the wire, after said rotation of around 315°, finds itself exactly in the position shown in FIG. 1A.

As soon as the positioning is carried out, the full drum pack is removed leftwards, in the FIGS. 1 to 4, from the winding device which normally has available an automatic conveying device. A new drum pack is moved into the winding device and positioned, under the winding core 2. As soon as the drum pack is positioned, the motor 35 receives a further control signal and rotates now in the reverse direction so that the circumferential ring in the drawings according to FIG. 3 and 4, rotates anti-clockwise. At the same time, as soon as the positioning fingers reach the end of the lever guide in the region 47*b*, by way of the lever guide, they are removed from the winding core and finally reach back in their initial position. The wire now hangs down from the same storage finger from which it hung from before the activation of the wire positioning device. The wire can now no longer hang above the drum pack core or form knots. The storage fingers are now opened and the wire windings collected together can now fall in the empty drum pack without any impediment.

With the above described embodiment in total, four storage fingers and three positioning fingers are used. However, the number of storage fingers and positioning fingers can deviate from this amount. What is decisive is that the lever guide 47 is formed such that the forward movement of the positioning finger to the winding core first takes place when the positioning finger during the rotating movement has passed the storage finger which position is most favourable for the drum pack exchange. Furthermore, it is significant that the rotating movement is further carried out until the first positioning finger in contact with the winding core 2 comes to the preferred position beneath the storage finger 11.

According to the embodiment, four storage fingers are used having a respective angular position of 90° to one another, and three positioning fingers which likewise have an angular position of 90° to one another. The initial position of the positioning device is such that the first positioning finger 41 is located in the preferred position at an angular distance of 45° from the storage finger 11. Since the angular position between the storage finger 11 at the preferred position and the positioning finger 41, amounts to 45° a rotation of 315° must be carried out in order to rotate said first positioning finger 41 to be underneath said storage finger 11.

It should be pointed out, that also other numbers of positioning fingers call be used and that also the size of the angular rotation can also be different. What is significant is that the positioning finger first reaches the winding core behind or after the storage finger having the preferred position and is then rotated until it comes to position beneath the storage finger.

I claim:

1. Drum pack winding device for winding string-like goods, in particular wire, having an upper surface covering, insulated wire and the like, comprising:

a winding core (2) which is substantially cylindrical and is arranged vertically;

a depositing device which deposits wire windings onto said winding core, whereby the winding core is formed such that the respective lowermost wire windings fall into a winding drum pack (4) arranged underneath the winding core as soon as the number of wire windings wound on the winding core overshoots a predetermined number, a catch device comprising at least three storage fingers (11, 12, 13, 14) distributed around the circumference of the winding core and which are movable relative to the winding core (2) in such a way that they hold the wire windings wound on the winding core during the changing of the winding drum pack, characterized by further comprising, a wire positioning device having a rotatable ring (30) arranged concentric to the winding core, whereby on said ring a number of positioning fingers (41, 43, 44) are movably guided, said fingers being arranged at an angular distance to one another;

a driving device (32, 33, 35) controlled by a control device by means of which the rotatable ring (30) is rotatable from a first, initial position which the ring occupies before the changing of the drum pack, to a second, changing position which the ring occupies during the changing of the drum pack;

a guiding device (47) by means of which the positioning fingers are guided, whereby the guiding device is formed such that the positioning fingers are transferred from a first position in which they are held at a distance to the winding core, to a second position in which they are in contact with the winding core, whereby said movement of the positioning fingers is then carried out when the positioning fingers have crossed a first storage finger (11), during the rotation from the initial position to the changing position, and which position is particularly favourable for the changing of the drum pack; and in that the control device is formed such that the rotation of the rotating ring (30) is stopped when the first positioning finger (41) which reaches the position contacting with the winding core (2), is located vertically below the first storage finger (11); and in that the driving device (32, 33, 35) rotates the rotating ring (30) after the changing of the drum pack from said changing position back to said initial position.

2. Device according to claim 1, characterized in that the number of positioning fingers (41, 43, 44) equals but one less than the number of storage fingers (11, 12, 13, 14) and that the separating angle of the positioning fingers corresponds to the separating angle of the storage fingers, whereby, when the rotating ring (30) is in its changing position, below the second storage finger (12) which lies in the rotating direction from the initial position to the changing position behind the first storage finger (11), there is no positioning finger.

3. Device according to claim 2, characterized in that the storage finger and/or the positioning finger are formed substantially as cylindrical rods whose cylindrical axis extends through the cylindrical axis of the winding core (2).

4. Device according to claim 3, characterized in that the guiding device is formed as a lever guide (47) and that each positioning finger has at least one roller (46) which is supported on said lever guide (47).

5. Device according to claim 3, characterized in that the rotating ring (30) is formed substantially cylindrical and its outer circumference is formed as a belt disk which receives a belt (32) which is connected with the driving device (35).

6. Device according to claim 4, characterized in that the rotating,ring (30) is formed substantially cylindrical and its outer circumference is formed as a belt disk which receives a belt (32) which is connected with the driving device (35).

7. Device according to claim 2, characterized in that the guiding device is formed as a lever guide (47) and that each positioning finger has at least one roller (46) which is supported on said lever guide (47).

8. Device according to claim 7, characterized in that the rotating ring (30) is formed substantially cylindrical and its outer circumference is formed as a belt disk which receives a belt (32) which is connected with the driving device (35).

9. Device according to claim 2, characterized in that the rotating ring (30) is formed substantially cylindrical and its outer circumference is formed as a belt disk which receives a belt (32) which is connected with the driving device (35).

10. Device according to claim 1, characterized in that the storage finger and/or the positioning finger are formed substantially as cylindrical rods whose cylindrical axis extends through the cylindrical axis of the winding core (2).

11. Device according to claim 10, characterized in that the guiding device is formed as a lever guide (47) and that each positioning finger has at least one roller (46) which is supported on said lever guide (47).

12. Device according to claim 11, characterized in that the rotating ring (30) is formed substantially cylindrical and its outer circumference is formed as a belt disk which receives a belt (32) which is connected with the driving device (35).

13. Device according to claim 10, characterized in that the rotating ring (30) is formed substantially cylindrical and its outer circumference is formed as a belt disk which receives a belt (32) which is connected with the driving device (35).

14. Device according to claim 1, characterized in that the guiding device is formed as a lever guide (47) and that each positioning finger has at least one roller (46) which is supported on said lever guide (47).

15. Device according to claim 14, characterized in that the rotating ring (30) is formed substantially cylindrical and its outer circumference is formed as a belt disk which receives a belt (32) which-is connected with the driving device (35).

16. Device according to claim 1, characterized in that the rotating ring (30) is formed substantially cylindrical and its outer circumference is formed as a belt disk which receives a belt (32) which is connected with the driving device (35).

17. A method for positioning wire during the process of changing a drum pack in a drum pack winding device having a substantially cylindrical winding core arranged vertically on which wire windings are collected during the changing process, said method comprising:

holding the wire windings with three or more storage fingers, distributed around the circumference of the winding core, rotating a wire positioning device arranged below said storage fingers and having a number of positioning fingers guided on a rotatable ring arranged concentric to the winding core, guiding said positioning fingers in such a way that during rotation of said rotatable ring, the positioning fingers contact the winding core as soon as the positioning fingers have crossed the first of said storage fingers, said first storage finger having the shortest distance to the filled drum pack during the changing of the drum pack, and stopping the rotation of said rotatable ring as soon as the first positioning finger which contacts the winding core during the rotation is substantially located in an angular position corresponding to the angular position of said first storage finger.

* * * * *